United States Patent [19]

Calvert

[11] 4,332,123

[45] Jun. 1, 1982

[54] PACKAGING MACHINE AND METHOD

[75] Inventor: Rodney K. Calvert, Dunwoody, Ga.

[73] Assignee: The Mead Corporation, Dayton, Ohio

[21] Appl. No.: 161,799

[22] Filed: Jun. 23, 1980

[51] Int. Cl.[3] ..... B65B 21/04; B65B 21/12

[52] U.S. Cl. ..... 53/475; 53/48; 53/564

[58] Field of Search ..... 53/48, 564, 245, 247, 53/537, 473, 475, 458

[56] References Cited

U.S. PATENT DOCUMENTS

| | | | |
|---|---|---|---|
| 2,615,289 | 10/1952 | Hickin | 53/247 X |
| 2,803,932 | 8/1957 | Nigrelli et al. | 53/247 X |
| 2,921,425 | 1/1960 | Seval | 53/247 |
| 2,978,854 | 4/1961 | Fairest | 53/247 X |
| 3,848,519 | 11/1974 | Ganz | 53/48 X |
| 3,864,890 | 2/1975 | Ullman | 53/247 X |
| 3,938,847 | 2/1976 | Peyton | 53/247 X |
| 4,055,943 | 11/1977 | Reichert | 53/247 |
| 4,078,357 | 3/1978 | Ida | 53/48 X |

*Primary Examiner*—Horace M. Culver
*Attorney, Agent, or Firm*—Erwin Doerr

[57] ABSTRACT

A packaging machine includes a bottle carrier erector section, a bottle infeed and carrier transfer section and a bottle loading section. The erector section continuously sets up carriers which are then transferred to the loading section and at the same time bottles continuously are supplied to the loading section. The loading section includes a suspension feed line for the bottles and a carrier feed line to feed carriers in the same direction as and below the suspension feed line. The carrier feed line and bottle feed line converge and are so timed that each bottle arrives at a position directly above a carrier when the convergence of the feed lines has brought the bottle into close proximity with a carrier. Each bottle is caused to enter a carrier at an angle to the vertical and means are provided for controlling the bottle attitude and for causing detachment from the suspension feed line to deposit the bottle in a carrier at the appropriate moment.

9 Claims, 7 Drawing Figures

PACKAGING MACHINE AND METHOD

TECHNICAL FIELD

This invention relates to a machine for setting-up basket style bottle carriers of the type shown in U.S. Pat. No. 4,187,944 from a collapsed condition and subsequently loading the set-up carriers with bottles in a continuous operation.

BACKGROUND ART

Machines for erecting bottle carrier cartons from a collapsed into a set-up condition are well-known in the art as evidenced by U.S. Pat. Nos. 2,780,970 to Gentry, 3,027,815 to Anness et al, and 3,343,466 to Sherman. Typical examples of machines for loading articles into cartons are found in U.S. Pat. Nos. 3,332,200 to Englander, 3,553,927 to Anglade, and 3,864,890 to Ullman. The latter two patents show arrangements wherein bottles are advanced along a downwardly inclined path while being suspended from their necks and then placed or drop-loaded into cartons or crates. Such machines, however, have serious deficiencies as will be pointed out hereinafter.

DISCLOSURE OF THE INVENTION

In general, the machine of the present invention comprises a bottle carrier erector section, a bottle infeed and carrier transfer section and a bottle loading section. The erecting section continuously withdraws collapsed carriers 'F' from a supply, erects the collapsed carriers into set-up condition and delivers the set-up carriers for transfer to the loading section. Simultaneously, at the bottle infeed section, one or more rows of bottles are continuously supplied for presentation to a suspension feed line at the loading section.

The loading section itself comprises means for feeding a succession of bottle carriers in the same direction as and below the bottle suspension feed line, with the carrier feed and the bottle feed converging and so timed that each bottle arrives at a position directly above a carrier to receive it when the convergence of the feed lines has brought the bottom of the bottle to a position above the base of the carrier, means for controlling the attitude of the bottle so that the bottle is caused to enter the carrier at an angle with respect to the vertical, and means for detaching the bottle from the feed line so that the bottle is deposited in the carrier.

The controlled angular relationship of the bottle with respect to the carrier during loading is provided to minimize the risk of damage to bottles, bottle labels and also to the carriers and the machine itself caused by bottle 'hang-up' which is liable to occur as bottles are introduced into the carriers. It is known to overcome this loading problem by creating an angular relationship between bottle and carrier but this has been achieved heretofor by presenting the carrier in a tilted position or causing the carrier itself to tilt at about the time of bottle release. However, the amount of control in positioning which can be achieved between bottle and carrier is limited.

The machine of the present invention has the advantage that the angular relationship between bottle and carrier can be accurately controlled and altered, so providing a consequential increase in machine operating speed and a decrease in machine stoppage.

BRIEF DESCRIPTION OF DRAWINGS

A specific embodiment of the invention, by way of example, is now set forth in the following description taken in conjunction with the accompanying drawings, in which.

BEST MODE OF CARRYING OUT THE INVENTION

Figure 1:
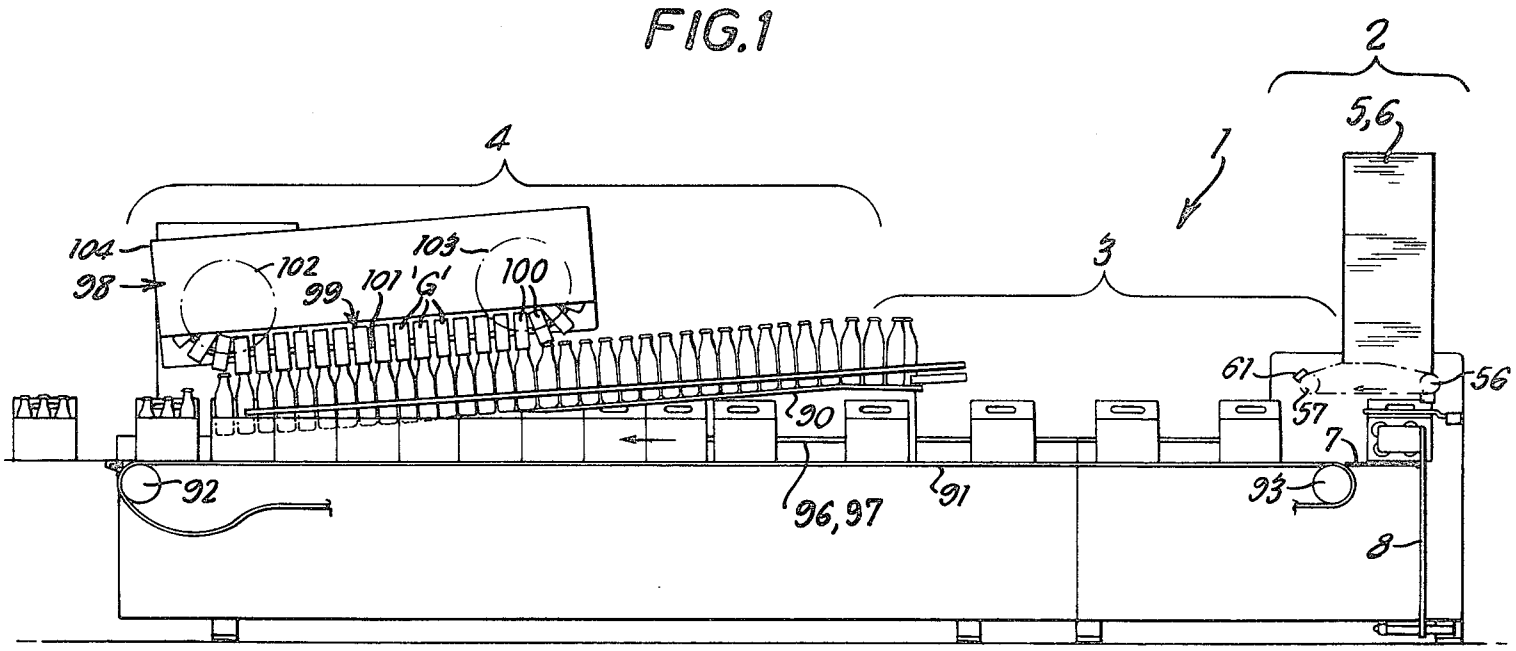
FIG. 1 is a general schematic side view of a packaging machine according to the invention.

Referring to the drawings, the packaging machine 1 basically comprises a bottle carrier erector section 2, a bottle infeed and carrier transfer section 3 and a bottle loading section 4.

Figure 2:
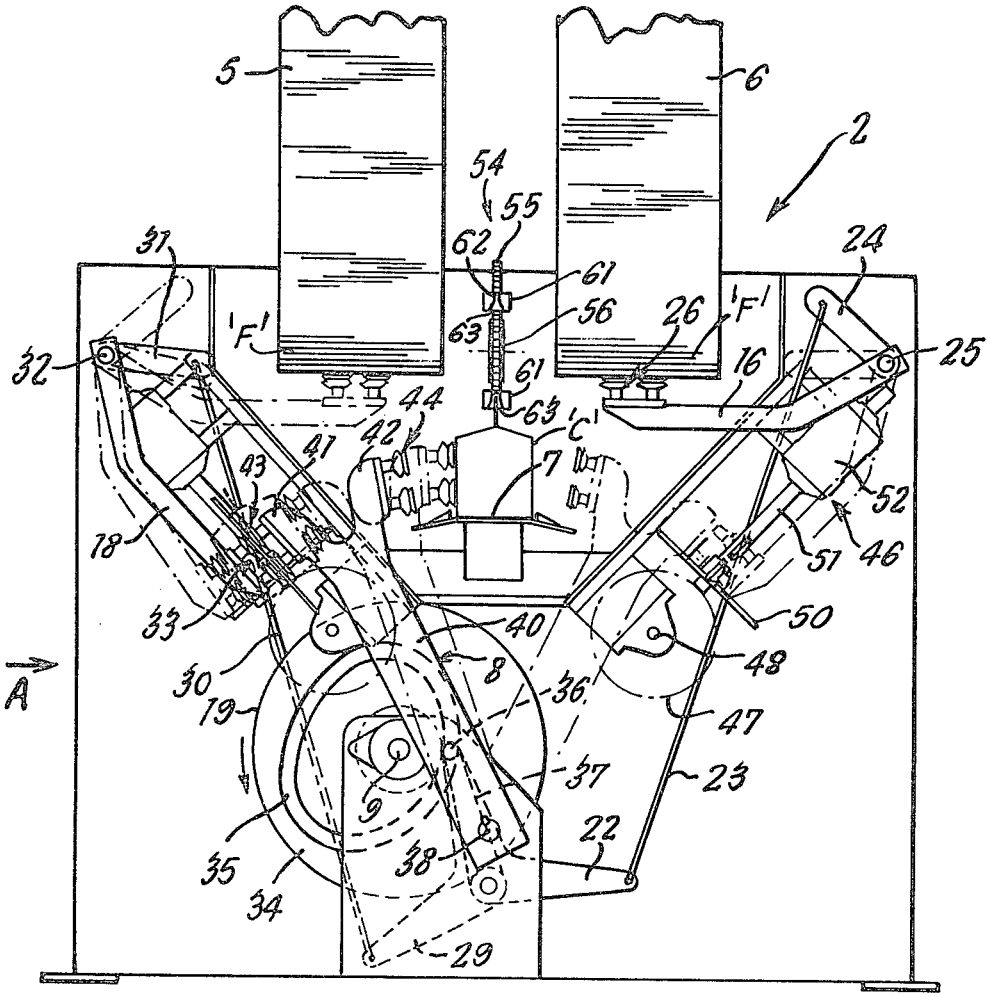
FIG. 2 is a end view of the carton erector section of the machine.
Figure 3:
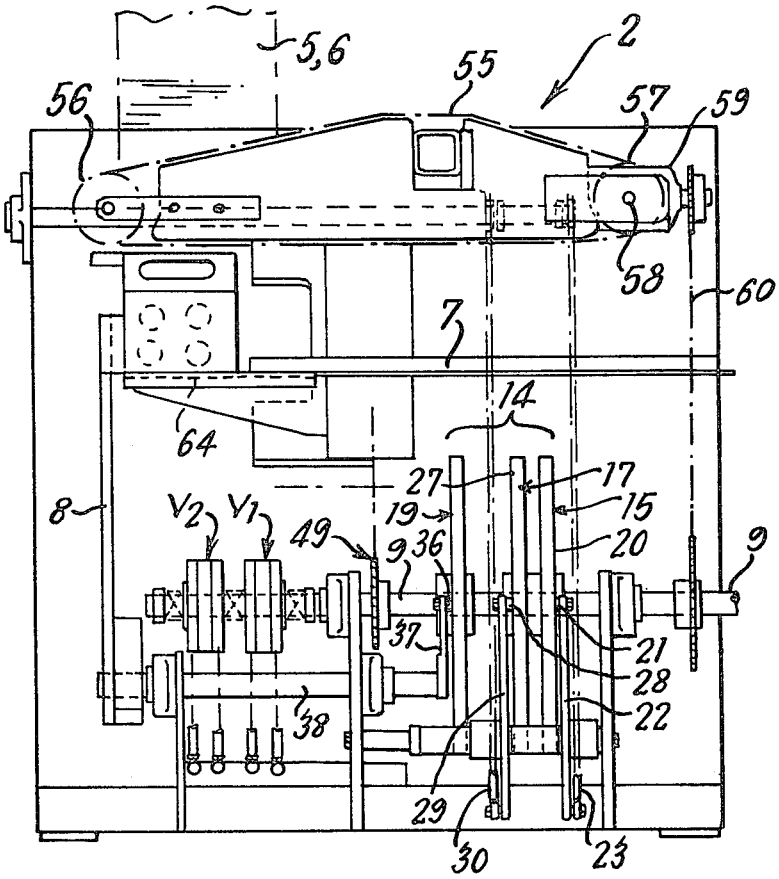
FIG. 3 is a side view of the carton erector section taken in the direction of arrow 'A' in FIG. 2.

The bottle erector section 2 best seen in FIGS. 2 and 3 comprises a pair of supply hoppers 5, 6 located in spaced side by side relationship above and straddling a carrier receiving platform 7. Each hopper accommodates a supply of flat collapsed bottle carriers 'F'. The carrier receiving platform 7 is located centrally in the carrier erector section 2 and has erected carriers 'C' deposited thereon for transportation to the bottle loading section 4.

The erected carriers 'C' are deposited on platform 7 by means of an oscillatory bifurcated arm 8 which is driven from a camshaft 9 through a cam arrangement.

The carrier erector section 2 is as follows: A main driveshaft 10 extending longitudinally adjacent one side of the machine is powered by a suitable electric motor 11 and drives camshaft 9 via a sprocket and chain set 12 incorporating an air-clutch 13 (see FIG. 4). The camshaft 9 is geared down to operate at a lower rotary speed than that of the driveshaft 10. At the opposite end located within the erector section 2, the camshaft 9 carries a series of cam plate assemblies 14 for operating the carrier erecting components which include the oscillatory bifurcated arm 8. As best seen in FIGS. 2 and 3, the cam assemblies 14 comprise in series, a cam system 15 for imparting oscillatory movement to a suction-cup arm 16 which withdraws collapsed carriers 'F' sequentially from one (right hand) hopper 6, a cam system 17 for imparting oscillatory movement to a suction-cup arm 18 which withdraws collapsed carriers 'F' sequentially from the other (left hand) hopper 5, and a further cam system 19 for imparting oscillatory movement to the bifurcated arm 8 for cooperation with suction-cup arms 16 and 18.

The cam system 15 consists of a circular cam plate 20 having a continuous cam track (not shown) comprising a groove machined into one of its faces in which a follower roller 21 runs. The follower roller 21 is carried by a cam arm 22 which is attached to one end of a connecting rod 23. The connecting rod 23 extends upwardly within the erector section 2 and has its other end attached to a drive link 24 for imparting rotary motion to a short driveshaft 25 which carries the suction-cup arm 16. The free end of arm 16 is provided with a group of suction cups 26 which are vacuum operated by suitable pneumatic valves '$V_1$' located adjacent the free end of the camshaft 9. Similarly, the cam system 17 consists of a circular cam plate 27 having a continuous cam track (not shown) comprising a groove machined into one of its faces in which a follower roller 28 runs. The follower roller 28 is carried by a cam arm 29 which is attached to one end of a connecting rod 30. The connecting rod 30 extends upwardly within the erector section 2 and has its other end attached to a drive link 31 for imparting rotary motion to a short driveshaft 32 which carries tye suction-cup arm 18. The free end of arm 18 is provided with a group of vacuum cups 33 which are vacuum operated by the pneumatic valves '$V_1$' located adjacent the free end of the camshaft 9. The cam system 19 consists of a circular cam plate 34 having a continuous cam track comprising a groove 35 machined into one of its faces in which a follower roller 36 runs. The follower roller 36 is carried at one end of a cam arm 37 the opposite end of which is connected to one end of a rotatable shaft 38. The other end of shaft 38 is connected to the lower end of the bifurcated arm 8 which extends upwardly within the erector section 2 for oscillatory movement across the end of platform 7. The bifurcated arm 8 comprises a main stem 40 which terminates in a pair of branch arms 41, 42 each of which carries a group of suction cups 43, 44 respectively, adjacent its free end. The suction cups 43, 44 are vacuum operated by suitable pneumatic valves '$V_2$' located adjacent the free end of the camshaft 9.

In operation, power transmitted from the main driveshaft 10 via the chain and clutch drive 12, 13 to camshaft 9 causes the circular cam plates 20, 27 and 34 to rotate together thereby causing the cam follower rollers 21, 28 and 36 to move around their respective cam tracks.

Referring to FIGS. 2 and 3, for initial withdrawal of a carrier from hopper 6, the suction-cup group 26 at the end of arm 16 is engaged with one side wall of the lowermost collapsed carrier 'F' in the stack within hopper 6 and a suction force then applied by activating pneumatic valves '$V_1$'. As rotation of the cam system 15 continues the suction-cup arm 16 is caused to move downwardly by transmission of motion through the connecting rod 23 whereby the lowermost collapsed carrier is withdrawn from the hopper stack. During this procedure the bifurcated arm 8 is caused to pivot by rotation of cam system 19 such that the branch arm 42 is moved towards the downwardly swinging suction-cup arm 16. When the suction-cup arm 16 reaches its lowermost position (as shown in phantom in FIG. 2), the bifurcated arm 8 has reached the end of its pivotal movement in that direction whereupon the suction-cup group 44 of arm branch 42 engages with the opposite sidewall of the withdrawn carrier and a suction force is then applied via pneumatic valves '$V_2$'.

The suction-cup arm 16 now experiences a pause caused by a dwell period in the cam system 15 while at the same time suction force in the suction-cup groups 26 and 44 is maintained and rotation of cam system 19 causes bifurcated arm 8 to pivot in the opposite (return) direction thus causing the branch arm 42 to move away from suction-cup arm 16. The effect of maintaining suction force in suction-cup grounds 26 and 44 during return motion of arm 8 is that the carrier sidewalls are moved apart thus causing the carrier to be brought into its expanded condition. The carrier walls are then locked to maintain the set-up condition as explained shortly. Instantaneously, after the setting-up procedure vacuum force applied by suction-cup group 26 is relieved so that the carrier is released from engagement with suction-cup arm 16. Bifurcated arm 8 continues its return pivotal movement during which time the suction-cup arm 18 withdraws a carrier blank from hopper 5 by action of cam system 17 in a manner similar to that described with reference to the withdrawal procedure from hopper 6. Generally simultaneously with this action, the suction force applied to a sidewall of set-up carrier 'C' by the group of suction cups 44 is relieved when branch arm 42 is adjacent platform 7 whereby carrier 'C' is released and deposited on the platform 7.

At the completion of the return pivotal movement the suction-cup group 43 of arm branch 41 engages the uppermost sidewall of the collapsed carrier withdrawn from hopper 5 by arm 18 and the other suction-cup arm 16 pivots upwardly towards hopper 6 to begin the next succeeding carrier withdrawal procedure. Suction force is applied through suction-cup group 43 so that the newly withdrawn collapsed carrier 'F' is engaged for the setting-up operation. Thus the carrier withdrawal and setting-up procedure continues with the oscillatory movement of bifurcated arm 8 allowing collapsed carriers to be withdrawn from the pair of hoppers alternately and deposited onto platform 7 for transportation to the bottle loading section 4.

Figure 6:
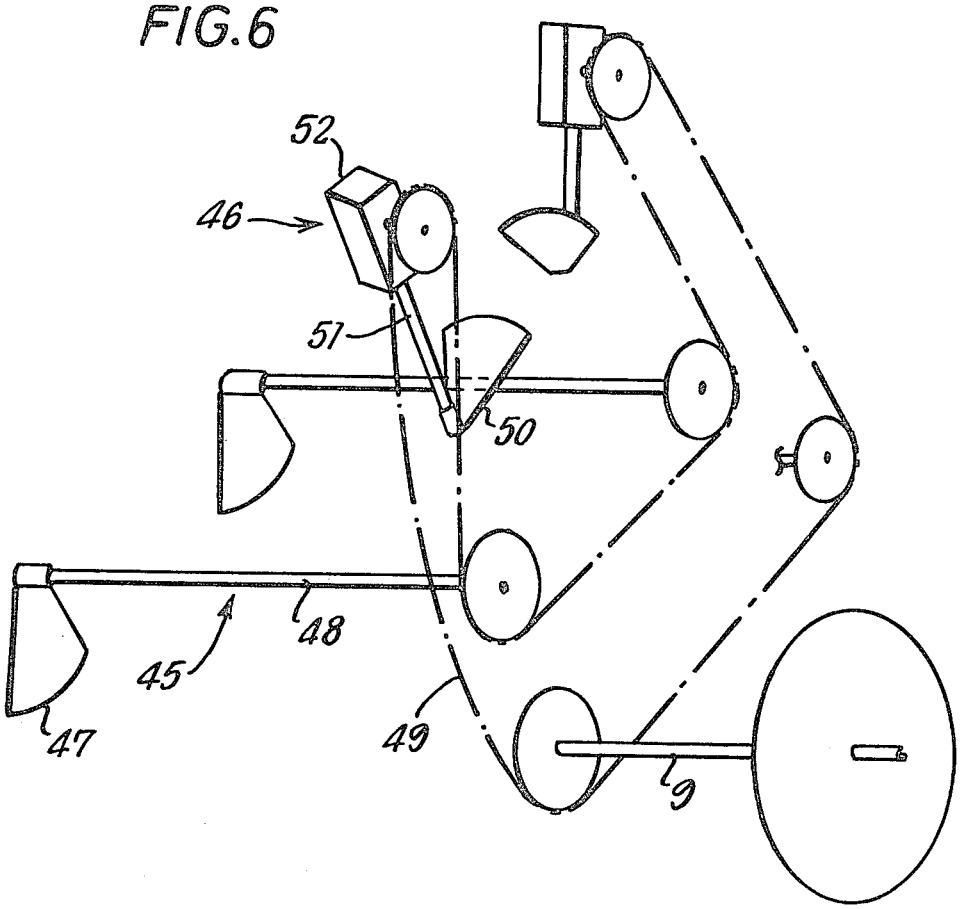
FIG. 6 is a schematic diagram showing the carrier locking devices and their drive connections.

The carrier locking operation, previously referred to, is achieved by means of two sets of rotatable locking devices timed for operation from the camshaft 9 and driven by an endless chain 49 trained about sprockets associated with each set of locking devices and with camshaft 9 as shown in FIG. 6. One set of such locking elements is located adjacent each side of platform 7 so that expanded carriers are locked immediately prior to being deposited on platform 7.

Referring to FIGS. 2 and 6, each set of locking devices comprises a bottom wall pusher plate assembly 45 and an end wall pusher plate assembly 46. The assembly 45 comprises segmental plate 47 carried at one end of a rotatable shaft 48 located adjacent platform 7 with shaft 48 extending parallel to the camshaft 9. The opposite end of shaft 48 is provided with a sprocket by which shaft 48 is driven in an appropriately timed manner via chain 49. The assembly 46 comprises a similar segmental plate 50 carried at one end of a rotatable shaft 51 which extends downwardly adjacent platform 7 with its axis inclined and normal to that of the camshaft 9. The opposite end of shaft 51 is housed in a gearbox 52 through which the shaft is driven via a sprocket associated with the gearbox and chain 49. The relationship of the sprockets is such that the sprocket associated with the camshaft 9 makes one-half revolution while the sprockets associated with shaft 48 and 51 make a full revolution per carton. The two sets of locking devices are arranged to operate in sequence so that immediately upon expanding the carrier the end wall thereof is urged inwardly past the adjacent end edge of the bottom wall by rotation of the segmental plate 50 wiping across the end wall whereafter the bottom wall is urged upwardly by rotation of the segmental plate 47 wiping across the carrier base so that the locking parts of those carrier walls are engaged to maintain the carrier in its set-up condition. The transportation of set-up carriers 'C' from the carrier receiving platform 7 to the bottle loading section 4 is initiated by an overhead conveyor assembly 54 located above the carrier receiving platform 7.

Figure 4:
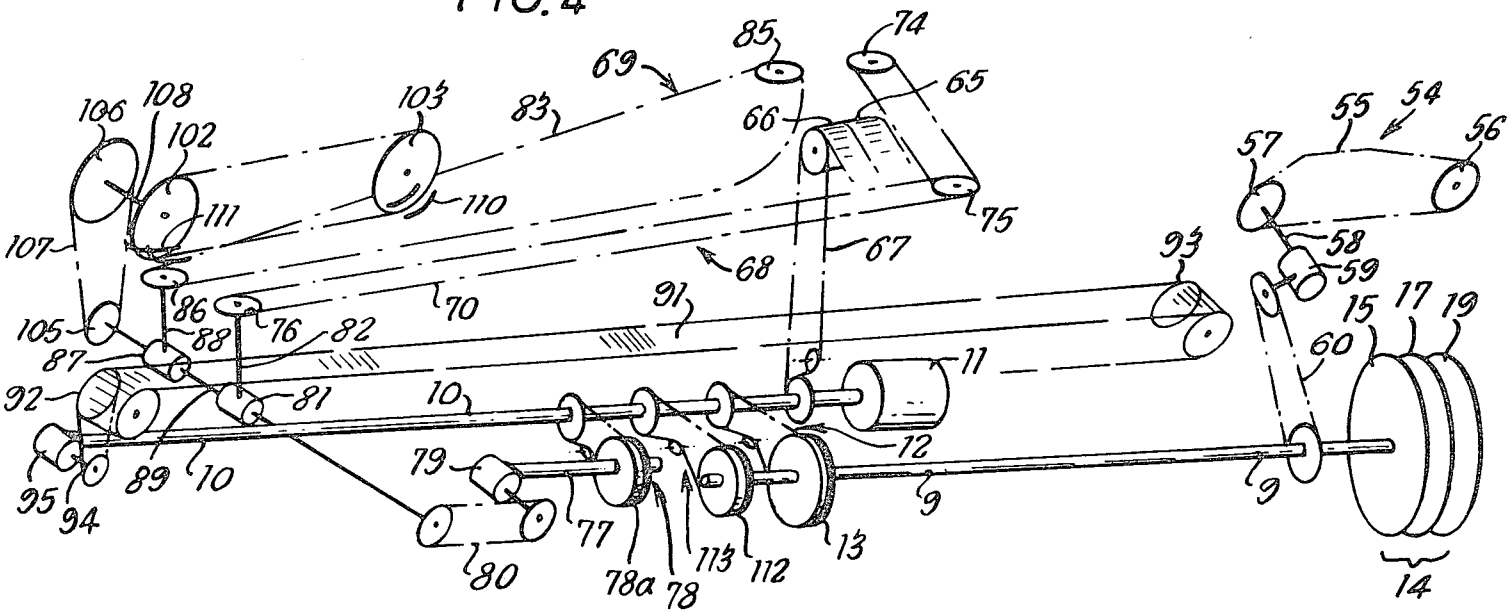
FIG. 4 is a schematic diagram showing the various drive assemblies and connections of the machine.

Referring to FIGS. 2, 3 and 4, the assembly 54 comprises a continuous chain 55, passing around an idler sprocket 56 and a drive sprocket 57 spaced from the idler sprocket 56 and both located with their axes transversely of the machine. The drive sprocket 57 is driven by a driveshaft 58 also extending transversely of the machine and which is powered at an appropriate speed through a gearbox 59 by means of a drive take-off from camshaft 9 provided by a chain and sprocket set 60 (see FIG. 4). In order to engage and move carriers 'C' which are deposited on the platform 7 the chain drive 55 includes a plurality of pusher elements 61 each for engagement with an upstanding handle section of a carrier (see FIG. 2). Each pusher element 61 comprises a block having formed therein a slot 62 with a flared mouth 63 into which the handle section of a carrier is received. The pusher blocks approach and engage the carriers from behind and transport the carriers along the platform 7 out of the carrier erector section 2 of the machine. As shown in FIG. 4, the platform 7 is formed with a reject aperture 64 through which incompletely set-up carriers are discarded.

Figure 5:
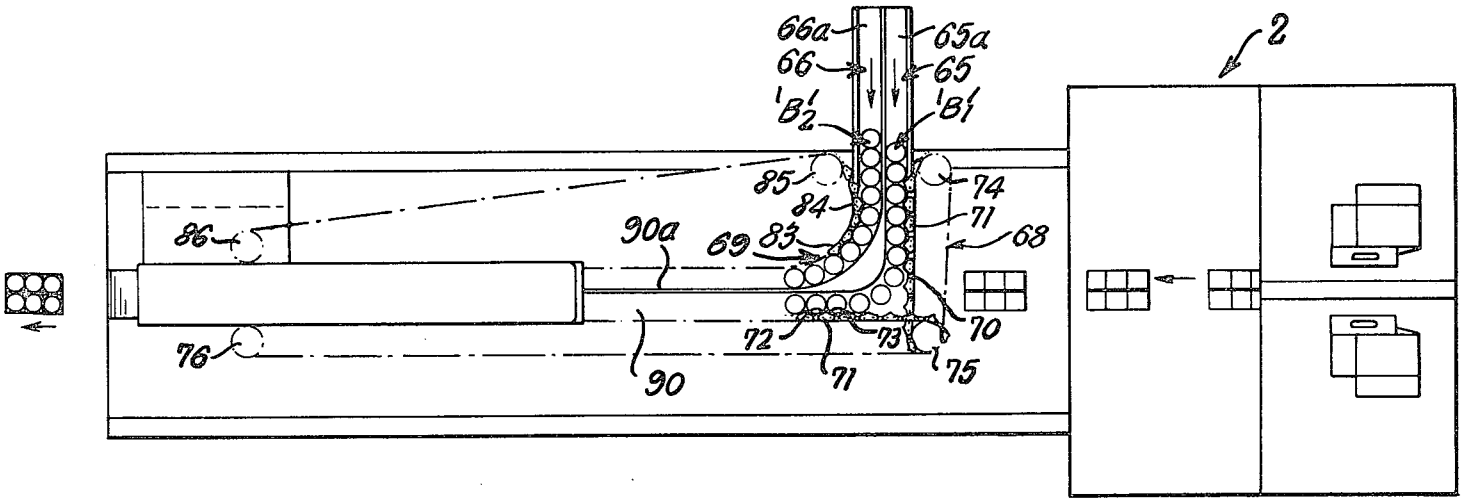
FIG. 5 is a schematic plan of the machine showing detail of the bottle infeed and guide systems.

Referring now to FIGS. 1, 4 and 5, the bottle infeed and carrier transfer section 3 comprises a pair of side-by-side continuous belts 65, 66, respectively, which extend transversely of the machine spaced from the outlet from the erector section 2. The belts have top conveying surfaces 65*a*, 66*a*, respectively, which are supported above the path of movement of the carriers and hence the carriers pass beneath conveying surfaces 65*a*, 66*a* as they move toward the bottle loading section 4 of the machine. The belts 65, 66 are driven by a geared-down drive take-off from the main driveshaft 10 provided by a chain and sprocket set 67 (see FIG. 4). Thus, bottles are fed transversely into the machine on the conveyor belts 65, 66 in two rows and then are diverted for movement along a longitudinal path centrally of the machine by guide belt systems 68, 69 respectively. It is envisaged that the bottle infeed may be arranged from either or both sides of the machine depending on the loading configuration and capacity required.

The guide belt system 68 for the bottle row '$B_1$' conveyed by belt 65 comprises a continuous chain 70 along which is spaced a multiplicity of articulated guide elements 71. Each guide element 71 comprises a pair of inwardly facing arcuate guide surfaces 72, 73 which are shaped to receive a part of the side wall of a bottle close to the bottle heel. The guide elements 71 are spaced apart along the chain 70 such that adjacent guide surfaces of neighboring elements together provide a curved recess into which a bottle can be snugly received (see FIG. 5). The chain 70 passes around idler sprockets 74, 75 adjacent infeed belt 65 and a drive sprocket 76 located at the outfeed end of the machine. Referring to FIG. 4, the power to drive sprocket 76 is transmitted through a drive take-off shaft 77 which extends parallel to main driveshaft 10 adjacent the opposite side of the machine. Drive is transmitted between the shafts 10, 77 by means of a chain and sprocket set 78 which is geared to cause drive take-off shaft 77 to rotate at a slower speed than driveshaft 10. The drive take-off set 78 incorporates an air clutch 78*a* by which the drive to shaft 77 can be engaged and disengaged. This feature permits the bottle loading section to be isolated from the carton erecting section 2. The outfeed end of shaft 77 is accommodated in a gearbox 79 which transmits drive through a further chain and sprocket set 80 to a gearbox 81 which drives the drive sprocket 76 connected to a stub shaft 82. It will be seen that chain 70 passes through a right-angle at the bottle infeed section 3 via idler sprocket 75 so that bottle guiding commences whilst the bottles of row '$B_1$' are conveyed into the machine on belt 65.

As shown in FIG. 5, the guide belt system 69 for bottle row '$B_2$' comprises a continuous chain 83 having articulated guide elements 84 constructed and arranged in a similar manner to the guide elements 71 previously described. The chain 83 passes around idler sprocket 85 located adjacent infeed belt 66 and a drive sprocket 86 located at the outfeed end of the machine. Referring again to FIG. 4 the power to drive sprocket 86 is transmitted through a gearbox 87 via stub shaft 88 on which the sprocket 86 is carried. The gearbox 87 is driven in unison with gearbox 81 of drive sprocket 76 by means of a transverse connecting shaft 89 whereby both drive sprockets 76, 86, respectively, and hence both guide belt systems 68, 69, respectively, operate at a coordinated speed. The central longitudinal path onto which the bottle rows '$B_1$', '$B_2$' are diverted from the infeed belts 65, 66 is provided by a downwardly inclined approach ramp 90 (see FIGS. 1 and 5) which extends from the bottle infeed section 3 to the bottle loading section 4 to convey bottles therebetween.

In order to convey carriers 'C' from the output end of the erector section 2 a longitudinal horizontal conveyor belt 91 is provided which extends centrally of the machine 1. The top conveying surface of belt 91 passes beneath the bottle infeed belts 65, 66 with sufficient clearance to permit carriers to pass through to the bottle loading section 4. The inclined approach ramp 90 which is spaced above carrier belt 91 is formed with a central longitudinal slot 90*a* into which the upstanding handles of the carriers 'C' are received when the clearance height between the approach ramp 90 and belt 91 becomes less than the overall carrier height owing to the downward inclination of the ramp 90. The carrier conveyor belt 91 passes around a drive sprocket assembly 92 located adjacent the outfeed end of the machine and an idler sprocket assembly 93 adjacent the carrier erector and feed section 2 (see FIG. 4). The drive sprocket 92 is powered by a chain drive 94 from a gearbox 95 driven by the main driveshaft 10 and located remote from motor 11. In order to guide carriers as they move along the carrier belt 91 the belt is flanked by longitudinal guide rails 96, 97 respectively which extend along the whole length of the carrier transfer and loading sections.

Figure 7:
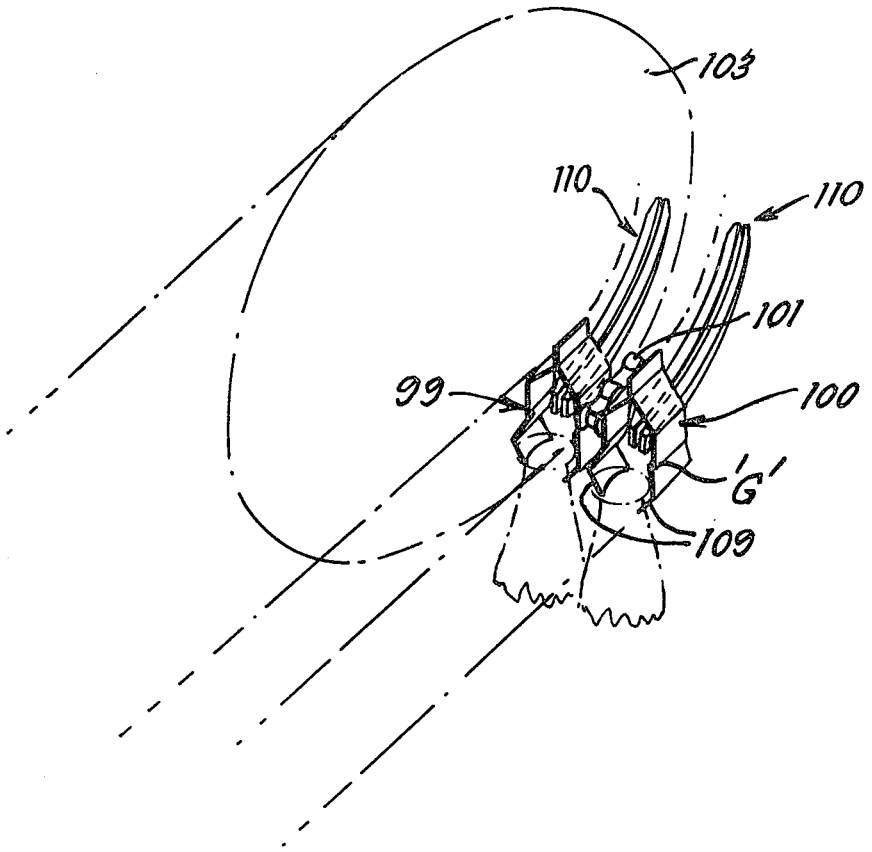
FIG. 7 shows schematically detail of the bottle suspension feed assembly.

Referring now to FIGS. 1, 4 and 7, in order to load the bottles of rows '$B_1$', '$B_2$' into carriers 'C' the bottles are taken from the inclined approach ramp 90 by means of an overhead suspension feed line assembly 98. The suspension feed line assembly comprises, for each bottle row, a series of gripper elements 99 and 100, respectively. The two gripper element series are connected together with the imposition of a continuous chain link belt 101 which passes between the series and around a pair of spaced chain sprockets comprising a drive sprocket 102 and an idler sprocket 103, respectively. The chain sprockets are supported on a frame assembly 104 extending along one side of the carrier belt so that the gripper elements 'G' move along and above the path of movement of the bottles '$B_1$', '$B_2$'. The chain sprockets are arranged such that the idler sprocket 103 has its axis located parallel to and above that of the drive sprocket 102 and is positioned to rotate adjacent the lower end of the bottle approach ramp 90. Thus both series of gripper elements 99, 100 include a lower run which follows an inclined path parallel to that of the bottle approach ramp 90.

Referring to FIG. 4, power is transmitted to the drive sprocket 102 by means of a drive take-off from the gearbox 87. The drive take-off comprises a sprocket drive 105 from gearbox 87 which transmits drive to a transfer sprocket 106 by means of a chain belt 107. The transfer sprocket 106 is connected in parallel with the drive sprocket 102 by means of a transverse connecting shaft 108.

As best seen in FIG. 7, the individual gripper elements 'G' comprise a pair of clamp arms 109 which are hinged together and spring loaded by suitable means so as to be biased in the closing direction. The mating ends of the clamp arms 109 are shaped to embrace the neck portion of a bottle and the arms are spaced apart sufficiently so that a portion of a bottle neck can be accommodated therebetween. In order to open and close the gripper elements there is provided for each of the gripper series 99, 100 a fixed cam plate adjacent the lower end of each sprocket 102, 103. A pair of fixed cam plates 110 for opening the arms 109 of the gripper elements 'G' comprise arcuate plates which have widened mid-sections and are located in the path of movement of the gripping element series whereby the gripper element arms 109 are forced apart at the widened mid-section as the arms pass along the cam plates. The opening is timed so that a bottle neck is received in the space between the opened arms during movement along the cam plates. When the gripper elements leave the cam plates 110 the spring loading of the arms cause them to move back in the closing direction and the bottle neck section is firmly gripped between the arms. A further pair of fixed cam plates 111 for releasing the bottles at the appropriate moment by re-opening the arms of the gripper elements 'G' are provided in the path of movement of the gripping element series beneath the drive sprocket 102. The further cam plates 111 are of similar construction to that of cam plates 110.

Referring now to FIGS. 1 and 7 the bottle loading operation is as follows: carriers 'C' continuously are transferred from the output end of the carrier erector section 2 towards the bottle loading section 4 along the conveyor belt 91. Simultaneously, the two rows of bottles '$B_1$', '$B_2$' are fed into the machine on bottle infeed belts 65, 66 and then diverted and guided by guide belt systems 68, 69, respectively, to move downwardly along the central inclined approach ramp 90. As each bottle reaches the lowermost end of the approach ramp 90 the neck portion of the bottle is brought into register with a gripping element 'G' which has just had its arms opened by one of the pair of fixed cam plates 110. As the bottle leaves the end of the approach ramp 90 the gripper arms close around the neck portion of the bottle so that the bottle is firmly suspended by the gripper element. Each bottle is maintained in the attitude at which they leave the approach ramp 90, i.e. inclined forwardly at an angle to the vertical by cooperation with the gripper element engaging the bottle neck and the belt guide systems engaging adjacent the bottle heel. Owing to the convergence and timing between the carrier feed line and the bottle suspension feed line each bottle successively is brought into a position to enter a carrier 'C' whilst in its inclined attitude. The angle of inclination of the bottle can be varied readily by adjustment of the gripper element attitude and the belt guide systems.

In this embodiment, groups of six bottles are loaded into each carrier provided by three successive bottles from each of the rows '$B_1$', '$B_2$'. The carrier is provided with partitions or compartments for each bottle so that the loaded bottles are correctly spaced to prevent glass to glass contact. Once a group of bottles has entered a carrier the lead pair of bottles of that group transmit the gripping element drive speed to the carriers so that the speed at which the carriers are metered is dictated by the bottle suspension feed line. As the bottle suspension feed line approaches the pair of fixed cam plates 111 the bottle attitude relative to the carrier nears the vertical owing to the shift in the direction of the gripper elements around drive sprocket 102. The fixed cam plates 111 cause the gripper elements 'G' to reopen at the time when the bottles already have entered their respective carrier compartments so that groups of bottles from each row are dropped successively into the carriers. Naturally, at this time the distance between the base of a bottle and its associated carrier base is small so that the drop is gentle. The filled carriers continue along the conveyer belt 91 and subsequently leave the machine for grouping and further packaging.

Owing to the coordinated timing required between the bottle suspension feed line and the carrier feed line it is necessary to ensure that a continuous row of carriers 'C' are backed up on the belt 91 within the bottle loading section 4. To this end a suitable detector device such as a photo electric cell (not shown) is positioned to transmit a signal when an interruption in the carrier feed line occurs. (Such an interruption may be due to a fault in the erector section 2 of the machine resulting in a temporary absence of carriers in the feed line). The signal from the detector device causes the air-clutch 13 to disengage drive to the camshaft via the chain and sprocket set 12 and simultaneously causes an air-clutch 112 to be engaged whereby camshaft 9 is driven through a chain and sprocket set 113 associated with air-clutch 112. The gearing ratio of the chain and sprocket set 113 is chosen such that the camshaft now operates at a faster speed than the drive speed via chain and sprocket set 13. Thus, the whole carrier erector section is driven at a faster speed so that carriers are delivered to the bottle loading section 4 at an increased speed until such time as the detector device registers that the regular carrier supply situation has been restored.

It will be appreciated that the machine of this invention provides an efficient carrier erector and supply arrangement and permits controlled bottle loading into the set-up carriers. The controlled bottle loading, which is achieved by controlled positioning and adjustability of bottle attitude, minimizes the occurrence of bottle 'hang-up' with the consequential improvements in machine operating efficiency.

What I claim is:

1. A method of loading bottles into bottle carriers comprising continuously feeding a succession of bottles carried by a downwardly inclined suspension feed line through a loading zone and feeding a succession of bottle carriers by means of a substantially horizontal carrier feed line in the same direction through said loading zone and below the suspension feed line, timing the feed of both said lines such that each bottle arrives at a position directly above a carrier when the convergence of said feed lines has brought the bottle and carrier into close proximity, characterized by controlling the attitude of the bottle so that it enters the carrier at a finite angle with respect to the vertical by gripping the bottle adjacent its top by means of gripping elements provided by said suspension feed line and by engaging the bottle adjacent its heel by means of guide elements located intermediate said suspension feed line and said carrier feed line, and detaching the bottle from said suspension feed line in said loading zone so that the bottle is deposited in the carrier.

2. A packaging machine for loading bottles into bottle carriers which machine comprises a suspension feed line by which bottles are held suspended and moved continuously through a loading zone, means for feeding a succession of bottle carriers in the same direction through said loading zone and below the suspension feed line, said suspension feed line being inclined downwardly in the direction of bottle and carrier feed and said carrier feed line being substantially horizontal, means for controlling the attitude of the bottles, while being suspended, in both longitudinal and transverse direction of the machine so that the bottles will enter the carrier at a predetermined finite angle with respect to the vertical, and means for causing the bottles to detach from said suspension feed line in said loading zone so that the bottles are deposited in the carrier, said attitude controlling means comprising gripping elements provided by said suspension feed line for holding the bottles to be loaded suspended by their necks and guide elements arranged for movement through said loading zone, said guide elements being constructed to engage the lower portions of the bottles carried by said suspension feed line so as to maintain the bottles at said pre-determined finite angle with respect to the vertical for loading into a carrier, means being provided to drive said gripping elements and said guide elements at a coordinated speed.

3. The packaging machine according to claim 2, in which said guide elements are carried on an endless chain located intermediate said suspension feed line and said carrier feed line, each of said guide elements including arcuate surfaces for engagement with a part of a bottle wall and being articulated with respect to an adjacent guide element.

4. The packaging machine according to claim 2, in which a ramp is located above said carrier feed line adjacent said loading zone, said ramp being downwardly inclined in the direction of carrier feed and providing a bottle feed approach along which bottles are fed and guided by said guide elements into said loading zone, and in which the lead bottles at the loading zone end of said ramp are gripped in turn by successive ones of said gripping elements.

5. The packaging machine according to claim 4, in which each gripper element comprises a pair of resilient arms biased in the closing direction, and in which opening devices are provided adjacent the approach ramp end of said loading zone to pry apart said arms so that the neck portion of a lead bottle can be received therebetween, said opening device thereafter allowing the arms resiliently to close into firm gripping engagement with said neck portion immediately prior to said lead bottle leaving the approach ramp whereby said bottle is transferred to said suspension feed line.

6. The packaging machine according to claim 5, in which said means for causing a bottle to detach from said suspension feed line comprises a further opening device provided at the opposite end of said loading zone to re-open said gripper arms whereby said bottle is released and deposited in a carrier.

7. The packaging machine according to claim 4, in which two chains of gripper elements are provided in side-by-side relationship and in that two chains of guide elements extend respectively along opposite sides of said approach ramp and said loading zone whereby two rows of bottles can be fed and loaded into said carriers simultaneously.

8. A packaging machine for loading bottles into bottle carriers, which machine comprises a loading section and a bottle carrier erecting section, said loading section comprising a suspension feed line by which bottles are held suspended and moved continuously through a loading zone, means for feeding a succession of bottle carriers in the same direction through said loading zone and below the suspension feed line, said suspension feed line and carrier feed line being arranged to converge with respect to one another, means for controlling the attitude of the bottles so that the bottles can be caused to enter the carrier at a finite angle with respect to the vertical, and means for causing the bottles to detach from said suspension feed line in said loading zone so that the bottle is deposited in the carrier, and said bottle carrier erecting section comprising a mechanism for setting-up said carriers from a collapsed to a set-up condition and presenting said set-up carriers to the carrier feed line, said mechanism including an arm mounted for pivotal movement between two carrier erecting locations, means at each of said erecting locations for holding a carrier during the carrier erecting procedure and wherein said arm includes attachment means for cooperation with each of said holding means to effect the erecting procedure, drive means being provided continuously to oscillate said arm from one of said carrier erecting locations to the other of said carrier erecting locations so that carriers are set up at each of said erecting locations alternately by cooperation between respective ones of said holding and attachment means.

9. The packaging machine according to claim 8, in which said attachment means comprises a plurality of suction elements located adjacent the free end of said arm such that there is a first suction element for cooperation with the holding means at one of said carrier erecting locations and an opposite facing second suction element for cooperation with the holding means at the other of said carrier erecting locations and wherein a platform is located intermediate said carrier erecting locations to receive set-up carriers, said platform being located such that the pivotal arm can pass across one end of said platform during oscillatory movement between said carrier erecting locations, and wherein said suction elements on the pivotal arm are actuated in turn to transfer a set-up carrier alternately from each of said carrier erecting stations to said platform, feed means being provided to move set-up carriers from said platform onto said carrier feed line.

* * * * *